US005084941A

United States Patent [19]

Brockmanns et al.

[11] Patent Number: 5,084,941

[45] Date of Patent: Feb. 4, 1992

[54] SLIVER DIVIDER HAVING A POSITIONABLE BLADE AND GUIDE WALLS

[75] Inventors: Karl-Josef Brockmanns, Willich; Siegfried Bruns; Theo Lembeck, both of Mönchengladbach, all of Fed. Rep. of Germany

[73] Assignee: W. Schlafhorst AG & Co, Mönchengladbach, Fed. Rep. of Germany

[21] Appl. No.: 593,085

[22] Filed: Oct. 5, 1990

[30] Foreign Application Priority Data

Oct. 5, 1989 [DE] Fed. Rep. of Germany ..... 3933218

[51] Int. Cl.[5] ..... D01G 15/40; D01G 15/58

[52] U.S. Cl. ..... 19/151

[58] Field of Search ..... 19/150, 151, 157, 257, 19/288, 298, 303

[56] References Cited

U.S. PATENT DOCUMENTS

| | | | |
|---|---|---|---|
| 2,109,176 | 2/1938 | Knight | 19/151 |
| 2,228,963 | 1/1941 | McGinnis | 19/157 |
| 2,399,007 | 4/1946 | Oesrosiers | 19/151 |
| 3,018,521 | 1/1962 | Harmon | 19/151 X |
| 3,135,023 | 6/1964 | Kalwaites | 19/151 X |
| 3,172,164 | 3/1965 | Crowther | 19/151 |
| 3,230,584 | 1/1966 | Kalwaites | 19/151 X |
| 4,364,152 | 12/1982 | Rauschen et al. | 19/105 |

FOREIGN PATENT DOCUMENTS

| | | | |
|---|---|---|---|
| 0008490 | of 1902 | United Kingdom | 19/151 |
| 1036483 | 7/1966 | United Kingdom | 19/151 |

*Primary Examiner*—Werner H. Schroeder
*Assistant Examiner*—Ismael Izaguirre
*Attorney, Agent, or Firm*—Herbert L. Lerner; Laurence A. Greenberg

[57] ABSTRACT

A sliver dividing device in a textile machine for a sliver travelling in a given direction comprises a sliver divider for dividing the sliver into at least two strands to be delivered to a work station for further processing. The sliver divider is movable in a direction substantially perpendicular to the given direction. In a preferred embodiment, the device includes guide walls for guiding the sliver with the sliver divider being disposed between the guide walls. In another preferred embodiment, the sliver divider is further rotateable about a pivot shaft and the guide walls are moveable and/or rotatable.

20 Claims, 4 Drawing Sheets

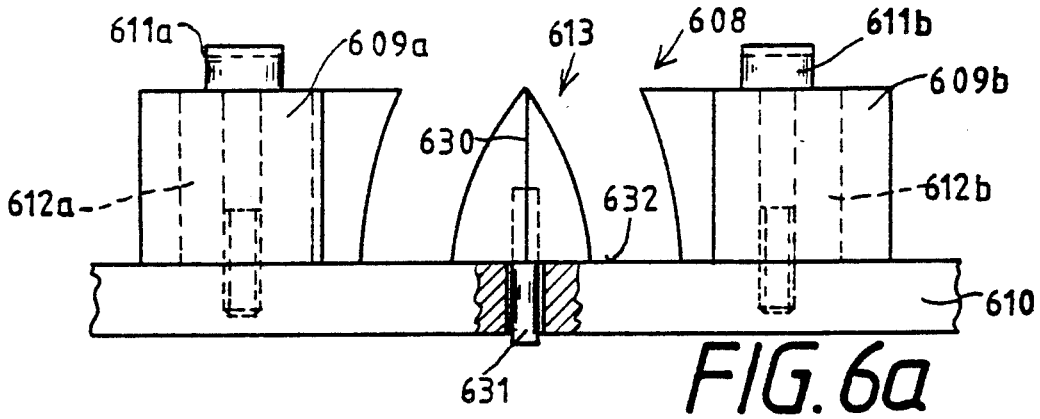
FIG. 6a
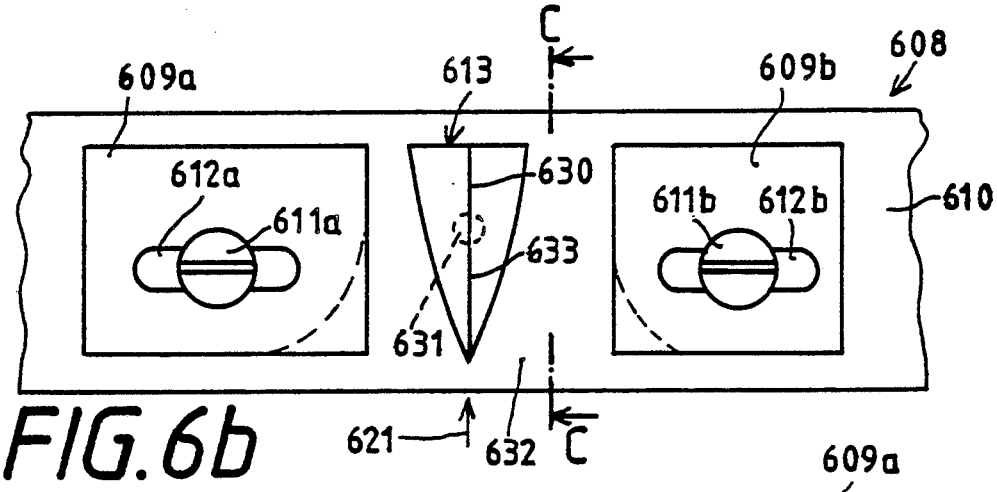
FIG. 6b
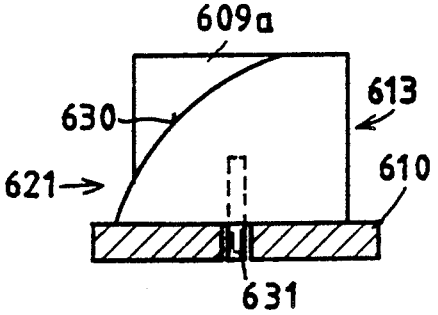
FIG. 6c
FIG. 7a
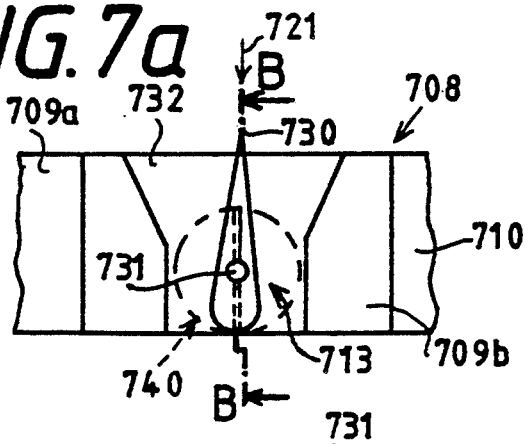
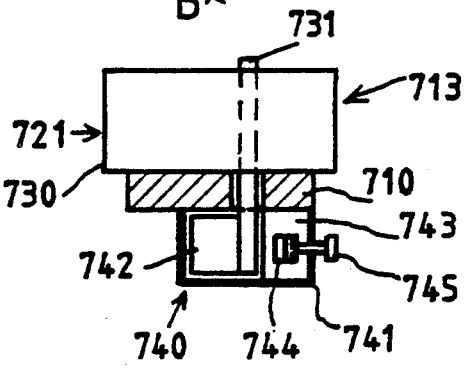
FIG. 7b

SLIVER DIVIDER HAVING A POSITIONABLE BLADE AND GUIDE WALLS

BACKGROUND OF THE INVENTION

1. Field of the Invention

The invention relates to a sliver divider on a textile machine, in particular on a drafting arrangement of a spinning machine, for dividing a sliver band into at least two strands that are delivered to a work station for further processing.

2. Description of the Related Art

Prior to the spinning process, the fibers to be processed must be prepared. In cotton, for instance, this is done by opening the bales, removing fibers from the bales, cleaning them and then depositing them as a web on a carder. To increase the cleanness of the fibers, improve their quality, or mix them with other fibers, strands can be produced from this card sliver that are in turn joined with the strands of other card slivers, mixed, and then drawn, in order finally to be deposited as sliver in a can, or wound to make a roving bobbin. So-called sliver dividers can already be used during the step of unraveling the web.

Prior to the spinning process, the sliver, deposited in cans or wound onto roving bobbins, undergoes a further preparation step. This includes paralleling of the fibers and attenuating the so-called feed roving in a drafting arrangement. There may also be sliver dividers within this drafting arrangement, which subdivide the partly drawn sliver still further, for the sake of further doubling or to produce twisted yarns. Drafting arrangements with sliver dividers are therefore especially found in air spinning machines, friction spinning machines and ring spinning machines.

The sliver dividers are disposed stationary in the travel route of the sliver. Usually, the sliver divider is located inside a sliver guide. In drafting arrangements on a spinning machine, the sliver divider is usually located between two devices for drafting the sliver, for instance between two apron-type drafting mechanisms. In other words, as seen in a direction of travel of the sliver, a drafting mechanism is followed by a sliver divider which is again followed by a drafting mechanism. German Published, Non-Prosecuted Patent Application 38 42 120, for instance, discloses a drafting mechanism provided with a so-called sliver parting and guiding apparatus, which comprises a shaft with a rotary element mounted on it and two laterally rotating sliver guides. This sliver parting and guiding apparatus is rotatable at right angles to the plane in which the sliver is transported, but otherwise is disposed in a stationary manner. The sliver is divided as if by a circular saw.

However, if a sliver divider is disposed rigidly, is it possible that the sliver may not be divided uniformly.

Depending on the sliver rotation and compression, the sliver may "creep" within the drafting arrangement. In this case, creep means that, because of nonuniform fiber distribution within the sliver, the sliver may swerve laterally away from its original path. With uneven drafting, the sliver creeps out of its path and no longer arrives at the sliver divider in the intended way. Accordingly, the sliver is no longer divided in the desired manner. In the least favorable case, the sliver divider may lose its function entirely, because the sliver may squeeze into one of the intended division paths, completely missing the sliver divider, therefore no longer being divided.

It is accordingly an object of the invention to provide a sliver divider, which overcomes the above-mentioned disadvantages of the heretofore-known devices of this general type, and which, even in the event of sliver creepage, always adheres to an initially desired division of the sliver.

SUMMARY OF THE INVENTION

With the foregoing and other objects in view there is provided, in accordance with the invention, a sliver dividing device in a textile machine for a sliver travelling in a given direction, comprising a sliver divider for dividing the sliver into at least two strands to be delivered to a work station for further processing, which sliver divider being movable in a direction substantially perpendicular to the given direction.

In contrast to the prior art, the sliver divider of the invention is disposed movably. As a result, it can follow the motions of the sliver and can execute the initially set sliver division properly even if the sliver should creep back and forth. To this end, its direction of motion is set at substantially right angles to the direction of motion of the sliver. Especially with elongated fibers, long, narrow sliver dividers can maintain their initially set position in the sliver even upon creepage of the sliver, as long as it can follow the creeping motion of the sliver or in other words if it is capable of deflecting laterally, or in other words perpendicularly to the direction of motion of the sliver.

Sliver creepage can be reduced substantially, if a sliver guide is provided and the sliver divider is disposed between the walls of a sliver guide.

As a rule, the sliver divider is disposed symmetrically between the walls of a sliver guide. However, depending on the work station following downstream of the sliver dividing and guiding device, a nonuniform division of the sliver may also be provided. In such a case, the sliver divider will be disposed asymmetrically between the walls of the sliver guide. Accordingly, due to the different spacing between, say, one of the guide walls and the sliver divider as compared to the spacing between the other guide wall and the sliver divider, the resulting sliver bands will have different sizes.

In accordance with a further feature of the invention, the sliver divider is displaceably disposed in the sliver guide; the direction of displacement is essentially at right angles to the direction of motion of the sliver. Because of the displaceability of the sliver divider, the sliver divider can advantageously follow all the motions of the sliver.

In accordance with an added, particularly advantageous feature of the invention, the sliver divider is disposed rotatably, with the pivot shaft substantially at right angles to the travel plane in which the sliver moves. The sliver divider is disposed with its axis in the sliver guide, such that its half located downstream the axis, as viewed in the direction of motion of the sliver, is located in a narrowed portion of the sliver guide. If the sliver now creeps because of irregularities, then a larger number of fibers is passed along one side of the sliver divider than on the other. In the narrowed portion of the sliver guide downstream of the pivot shaft, this results in an increased pressure on the sliver divider. The sliver divider deflects from the pressure and rotates about its axis, so that its rear half is rotated into the region where the smaller number of fibers exerts a lesser pressure on its rear half. As a result, the front part of the sliver divider is deflected into the direction of the part of the sliver that includes the increased number of fibers. Because of its oblique position, it divides the sliver in such a way that approximately the same number of fibers is moved past it on either side. The oblique position of the sliver divider will accordingly persist only until such time as the pressure on the side having the increased proportion of fibers is reduced, because of how the fibers are now being divided. Once a balanced proportion of fibers in each strand is attained, the sliver divider returns to its neutral longitudinal direction, in other words the direction in the which the sliver travels. The rotatably disposed sliver divider thus automatically counteracts both creepage of the sliver and uneven fiber distribution within the stands. The sliver divider is adjusted by the sliver itself. Accordingly, no external intervention whatever is needed to restore the intended division of the sliver.

In accordance with an additional feature of the invention, the sliver divider can be adapted optimally to the various fiber parameters. For instance, the sliver divider may be embodied in the shape of a wedge, and the narrow edge of the wedge may be oriented counter to the direction of motion of the sliver. Because of the wedge shape, the sliver is split parted, and a certain amount of compacting takes place at the wide ends of the wedge. In the event of uneven sliver distribution within the sliver, an increased pressure will occur at that point of the wedge-shaped sliver divider, so that the narrow end of the sliver divider will move toward the side of the sliver in which the greater accumulation of fibers is present. The sliver is newly divided, and the distribution of the slivers is effected such that virtually the same number of fibers moves past the sliver divider on the right and on the left. As a result, the same pressure is re-established on both sides of the sliver divider. The sliver is again uniformly divided and returned to its intended path.

In accordance with again another feature of the invention, the narrow edge of the sliver divider and the longitudinal axis of the pivot shaft are located in a common plane. As a result, the two strands are prevented from exerting undesirable torque on the sliver divider.

In accordance with again a further feature of the invention, undesirable torque is avoided by embodying the sliver divider symmetrically with the plane in which the narrow edge of the sliver divider and the pivot shaft are located. Because of the symmetrical design of the sliver divider, the same forces engage the side faces of the sliver divider from both divided strands, if the strands are of the same type.

In accordance with again an additional feature of the invention, the side walls of the sliver divider are provided to have the shape of a plow share. The blade of the plow share divides the sliver, and the curvature of the side walls prevents the fibers from migrating upward at the narrow point in the sliver guide.

In accordance with yet another feature of the invention, the sliver divider may also take the form of an inverted ship's bow, i.e. a ship stood on its deck. Just as the bow of a ship is intended to present particularly little resistance to the water, a thus-shaped sliver divider can effect a particularly favorable, eddy-free passage of the fibers past the sliver divider. The location of the fibers within the sliver is not intended to be disturbed by the sliver divider; that is, it should not have any influence on the drawn position of the fibers in the sliver. Shaping the sliver divider like a bow presents the least possible resistance to the fibers moving past it, and as a result also does not disturb the position of the fibers in the strands.

In certain cases, it may be necessary to provide means at the pivot shaft of the sliver divider for bringing to bear an adjustable counterforce oriented counter to the torque acting on the sliver divider due to the sliver. Particularly in fibers having a high coefficient of friction, even slight fluctuations in the sliver density of the two strands can cause swerving of the sliver divider. Uncontrolled fluttering of the sliver divider is undesirable, that is, uncontrolled swerving to the right and left. For this reason it is advantageous if the motion of the sliver divider is damped, for instance by using an adjustable damping of a known type.

In accordance with a concomitant feature of the invention, the guide walls of the sliver guide may be disposed rotatably and/or slideably. The combination of the two options may also be provided. This makes it possible, without changing the sliver guide, to adjust for various yarn parameters and sliver widths. The walls can also be better adapted to the shape of the sliver divider as a result, if one sliver divider is replaced for one having a different shape. Other features which are considered as characteristic for the invention are set forth in the appended claims.

Although the invention is illustrated and described herein as embodied in sliver divider, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE DRAWINGS

FIG. 6*a* is a front elevational view of a sliver guide with a sliver divider in the shape of a bow of a ship and having adjustable walls;

FIG. 6*b* is a top-plan view of the sliver guide of FIG. 6*a* with the side walls moved with respect thereto;

FIG. 6c is a sectional view of the sliver guide along the line C—C of FIG. 6b, seen in the direction of the arrows;

FIG. 7a is a top-plan view of a sixth embodiment of the sliver guide having a sliver divider onto which a counterforce can be applied; and FIG. 7b is a sectional view along the line B—B of FIG. 7a, as seen in the direction of the arrows.

DESCRIPTION OF THE PREFERRED EMBODIMENT

Figure 1:
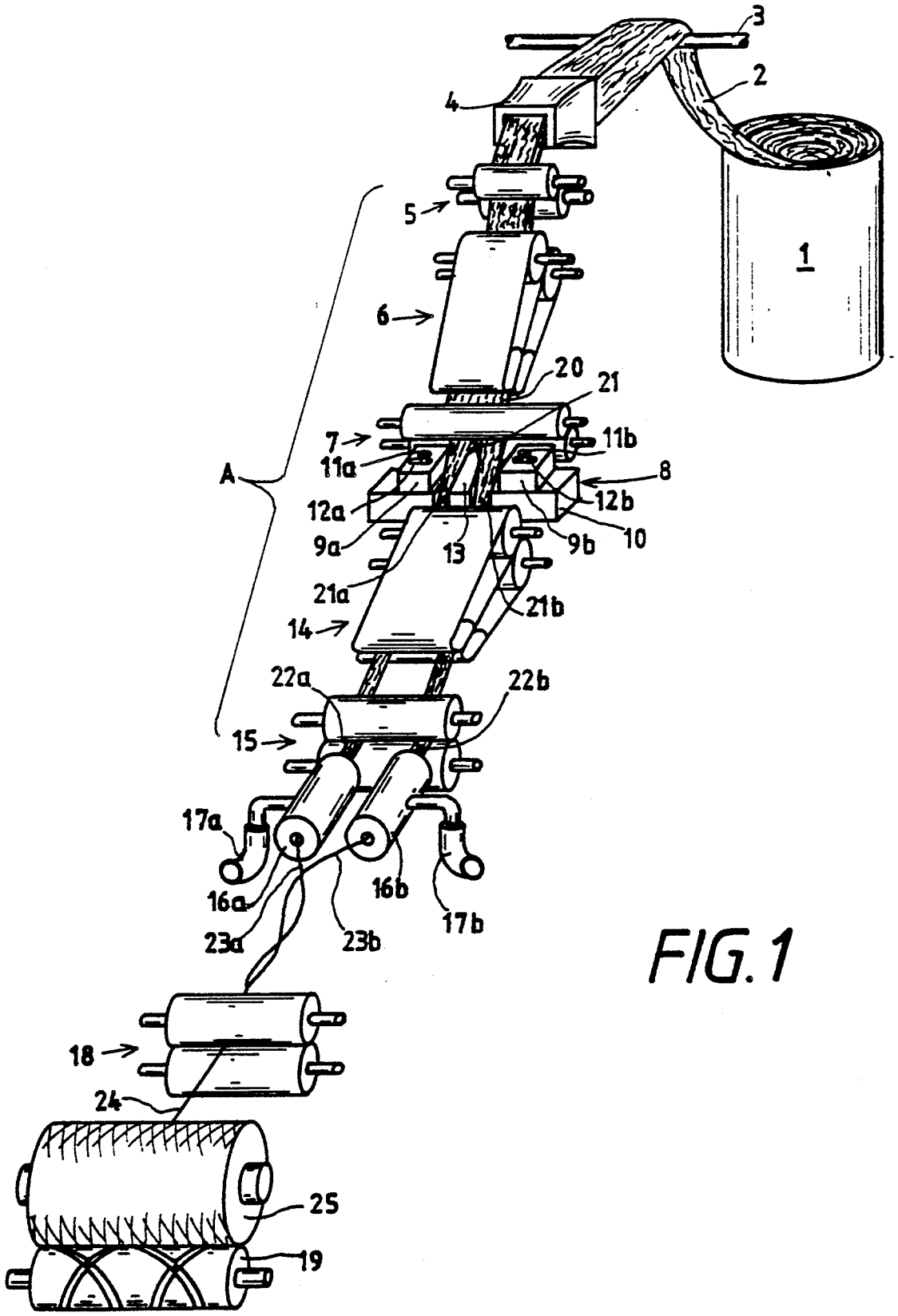
FIG. 1 is a diagrammatic, perspective view of an air spinning machine with a sliver divider according to the invention incorporated in the drafting mechanism.

Referring now to the figures of the drawings in detail, in which reference numerals are related by their two right-hand digits and in which the left-hand digit corresponds to the number of the respective figure, there is seen, particularly in FIG. 1 thereof, a spinning station in an air spinning machine in a diagrammatical, perspective view. Only the most important equipment, necessary for comprehension of the invention, of this spinning station is shown. The spinning station of an air spinning machine has been selected to represent all other textile machines in which the sliver divider according to the invention can be used.

From a can 1 which is ready at the spinning station, a sliver band or sliver 2 runs over a deflecting rod 3 into a drawing or drafting mechanism A. It is pulled into the drafting mechanism A through a compacter and a sliver guide 4 by a pair of feed rollers 5. The pair of feed rollers 5 is at the same time the back pair of rollers of a first double apron drafting mechanism 6. Here the first drafting of the sliver 2 takes place. The drawn sliver 20 then passes through a first pair of drafting rollers 7, which is the front pair of rollers of the double apron drafting mechanism 6. After that, it passes through the sliver guide 8. The guide walls 9a and 9b are adjustably disposed on a support 10 by means of fastening screws 11a and 11b, which are guided in the respective associated slots 12a and 12b. Disposed between the guide walls 9a and 9b is a sliver divider 13, which divides the already pre-drawn sliver 21 into two strands 21a and 21b. The strands pass through a further, second double apron drafting mechanism 14.

Two sliver band strands 22a and 22b which are ready for spinning leave the drafting mechanism A behind a second pair of drafting rollers 15.

As the work station, two air spinning nozzles 16a and 16b for air spinning of the drawn slivers 22a and 22b are disposed downstream of the drafting mechanism A. The supply of compressed air for the air spinning is effected via the connections 17a and 17b, respectively. A spinning fiber filament 23a leaves the air spinning nozzle 16a, and a spinning fiber filament or textile fiber 23b leaves the air spinning nozzle 16b. On their way to a pair of delivery rollers 18, they are twisted together and they run onto the yarn guide drum 19 in the form of the double end 24. The yarn guide drum deposits them in cross-wound layers into the cross-wound bobbin or cheese 25.

Figure 2:
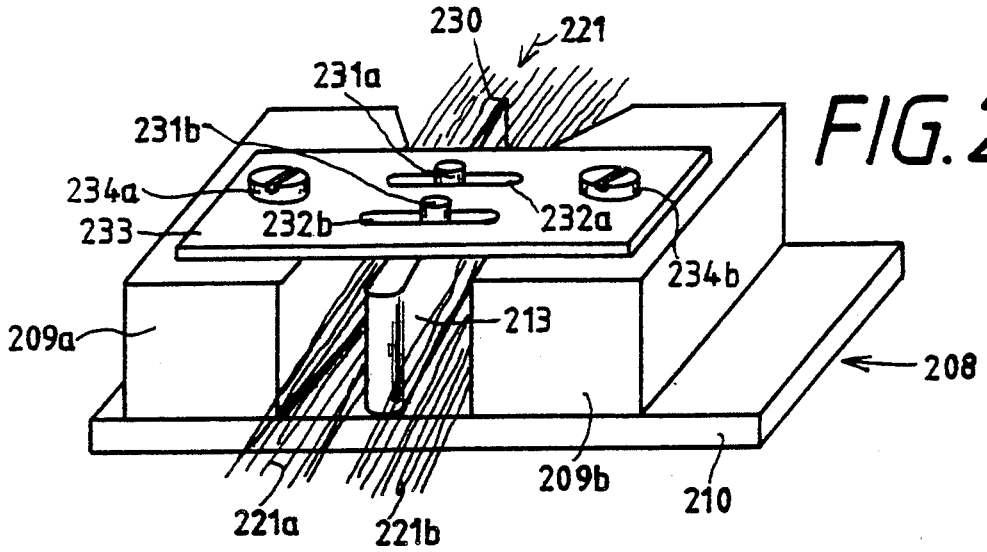
FIG. 2 is a perspective view of a first embodiment of a sliver guide with a sliver divider disposed displaceably therein.

FIG. 2 shows a first exemplary embodiment of a sliver divider according to the invention. The sliver guide 208 comprises two guide walls 209a and 209b, which are mounted on a support 210. This support 210 is not shown in further detail. It is secured inside the drafting arrangement on the machine. The pre-drawn sliver 221 enters the sliver guide 208 in the direction of the arrow. The guide walls 209a and 209b first open in the manner of a funnel at the entry point. The sliver divider 213 according to the invention is displaceably disposed in the middle, between the two guide walls 209a and 209b. The divider 213 is slightly wedge-shaped, with the narrow edge 230 facing counter to the direction of motion of the sliver 221. A narrow edge 230 is oriented vertically with respect to the plane of the sliver, which is defined by the orientation of the top surface of the support 210. The sliver is divided into two strands 221a and 221b by the sliver divider 213.

The sliver divider shown here is particularly suitable for use with long fibers, for instance long, smooth cotton fibers. Once it has been adjusted centrally, the elongated sliver divider seeks to maintain its position within the sliver 221. In the event of lateral creepage of the sliver, it tends to move with the creepage of the sliver.

The sliver divider 213 has two guide cams or cam followers 231a and 231b in succession in its longitudinal direction as seen in the direction of travel of the sliver, from the narrow edge 230 towards the wider back of the sliver divider 213. They are ovally shaped transversely to the longitudinal direction of the sliver divider 213 and are each guided in a respective groove 232a and 232b. The grooves are disposed transversely to the direction of sliver motion in a guide plate 233. The guide plate 233 is screwed with screws 234a and 234b to the guide walls 209a and 209b, respectively. The parallel orientation of the guide grooves 232a and 232b prevents a torsion of the sliver divider.

If the sliver 221 creeps transversely to its direction of motion, the sliver divider 213 is carried with it and displaces laterally. This leads to an increase in pressure against the sliver divider 213 on the side toward which the sliver has crept. The reason is the compression of the sliver on the side toward which the sliver has crept. Because of the length of the fibers and the length of the sliver divider, the sliver divider, due to the increased pressure on the thus compressed side, will return the sliver back to the center of the sliver guide.

Figure 3A:
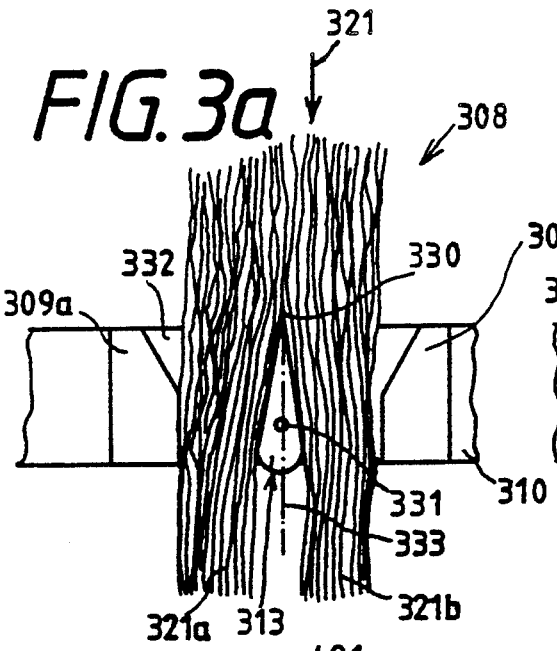
FIG. 3*a* is a top plan view of a second embodiment of a sliver divider disposed symmetrically in a sliver guide.
Figure 3B:
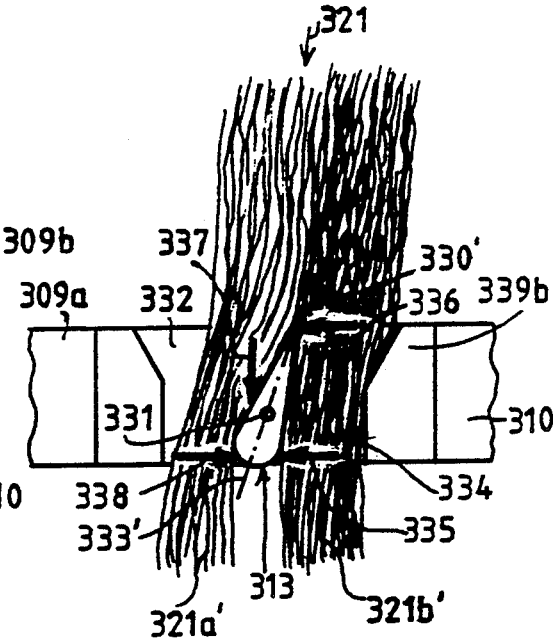
FIG. 3*b* is a view of the sliver guide of FIG. 3*a* with the sliver divider deflected by the creepage of the sliver.

In the second embodiment of a sliver divider illustrated in FIGS. 3a and 3b, the sliver guide 308 includes two parallel guide walls 309a and 309b, which open in funnel-like fashion counter to the direction of travel of the pre-drawn sliver 321 and then extend parallel to one another. They are mounted on a support 310 which is not illustrated in detail. The sliver divider 313 is disposed centrally between the two guide walls 309a and 309b. Once again it has the shape of a wedge; the narrow edge or blade 330 of the wedge faces upstream, opposite the direction of travel of the sliver 321. The direction of travel of the sliver 321 is indicated by the arrow just below the numeral 321. The sliver divider 313 is rotatable about a pivot shaft 331. This pivot shaft is vertical to the travel plane 332 of the sliver 321.

If the fiber distribution within the sliver cross section is undisturbed and uniform, the sliver divider will assume a neutral position within the sliver guide 308. As can be seen from the drawing, the narrow edge 330 of the sliver divider and the axis of its pivot shaft 331 are both located in a common plane 333 that is perpendicular to the travel plane 332 of the sliver 321. Furthermore, the sliver divider 313 is construed symmetrically with respect to the plane 333.

Because on the average an equal number of fibers is contained in both strands 321a and 321b, the forces exerted upon the sliver divider 313 by the strands are of equal magnitude, so that the sliver divider 313 assumes a neutral position inside the sliver guide; that is, the plane 333 is parallel to the parallel guide walls 309a and 309b of the sliver guide 308.

The effects of creepage of the sliver are shown in FIG. 3*b*. From the standpoint of the observer, the sliver 321 has crept toward the right, this causes an increased accumulation of fibers between the sliver divider 313 and the guide wall 309*b*. Substantially fewer fibers are located between the sliver divider 313 and the guide wall 309*a*. The result is two nonuniform strands, the thinner strand 321*a*' and the thicker strand 321*b*'. The wedge-like shape of the sliver divider 313 creates a narrow point between its rear end, located after the pivot shaft 131, and the guide walls 309*a* and 309*b*. The increased accumulation of fibers 334 between the rear, thicker end of the sliver divider 313 and the guide wall 309*b* leads to an increased pressure on the sliver divider 313 in this narrow point, so that a reaction force 335 acts upon the rear end of the sliver divider 313. The force vector on the sliver divider 313 lies in the direction of the arrow, at right angles to the guide wall 309*b*. The sliver divider 313 is rotated out of its position of repose, so that its narrow edge moves to the position 330'. The direction of motion of the narrow edge 330 is oriented essentially perpendicular to the direction of motion of the sliver, as indicated by the arrow 336. The reference numeral 333' indicates the axis along which both the narrow edge 330 and the pivot shaft 331 are oriented in the rotated state. The oblique position of the sliver divider 313 in the direction toward the increased accumulation of fibers 334 means that more fibers are diverted from the sliver strand 321*b*' to the strand 321*a*' or, in other words, from the right side toward the left side of the sliver divider. Accordingly the sliver divider automatically intervenes in the division of the sliver and makes a corresponding correction in fiber distribution. The changed division of the sliver by the obliquely positioned sliver divider leads to a change in the division in the amount of fiber and thus makes the two strands 321*a*' and 321*b*' uniform. Once the increased accumulation of fibers 334 disappears, the reaction force 335 upon the end of the sliver divider 313 disappears as well. The obliquely positioned sliver divider presents increased resistance 337 to the fibers of the strand 321*a*, and this brings about a reaction force 338 perpendicular to the guide wall 309*a*, causing it to return toward the left to its original central position.

The above makes it quite clear that the sliver divider 313 automatically equalizes an uneven distribution of the fibers inside the sliver 321. Any departure from uniform distribution of fibers within the sliver leads to a deflection of the sliver divider blade 330 toward the side of the sliver in which the increased number of fibers occurs. As a result, a new division of the sliver is automatically performed such that fibers are diverted to the side having less accumulation. A balance in fiber distribution within the sliver is thus achieved within minimum time, so that the sliver divider can assume its neutral position inside the sliver guide once again, or, in other words, it can resume its orientation parallel to the guide walls. At the same time, the mispositioning of the sliver is also overcome.

Sliver dividers that are rotatably disposed inside the sliver guide are particularly well suited for slivers made up of short fibers. Due to the fact that they are pivotable, sliver dividers of this kind react automatically and virtually without delay to any deviation in fiber distribution within the sliver and perform a speedy equalization thereof.

Figure 4:
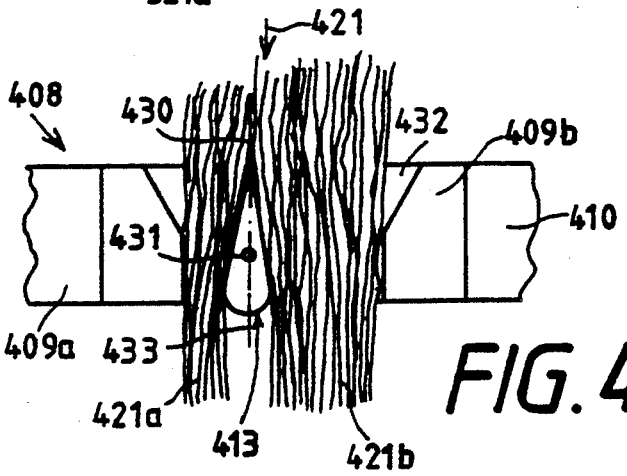
FIG. 4 is a top plan view of a third embodiment of a sliver divider disposed asymmetrically in a sliver guide.

FIG. 4 shows an asymmetrical disposition of a sliver divider 413 inside a sliver guide 408. The construction of the sliver guide 408 and the sliver divider 413 are similar to those illustrated in the above-described FIGS. 3*a* and 3*b*. The sliver divider 413 is asymmetrically disposed on the support 410 between the guide walls 409*a* and 409*b*. Its shaft 431 is disposed closer to the guide wall 409*a*, resulting in two strands 421*a* and 421*b* of unequal size. The sliver 421 is divided into a narrower strand 421*a* and a wider strand 421*b*. The mode of operation of the sliver divider is the same as that described with reference to FIGS. 3*a* and 3*b*.

Figure 5A:
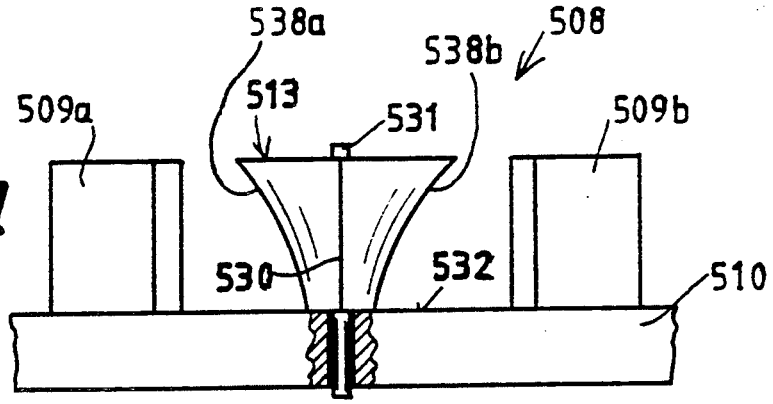
FIG. 5*a* is a front elevational view of a fourth embodiment of a sliver guide with a sliver divider having plowshare-like sidewalls.
Figure 5B:
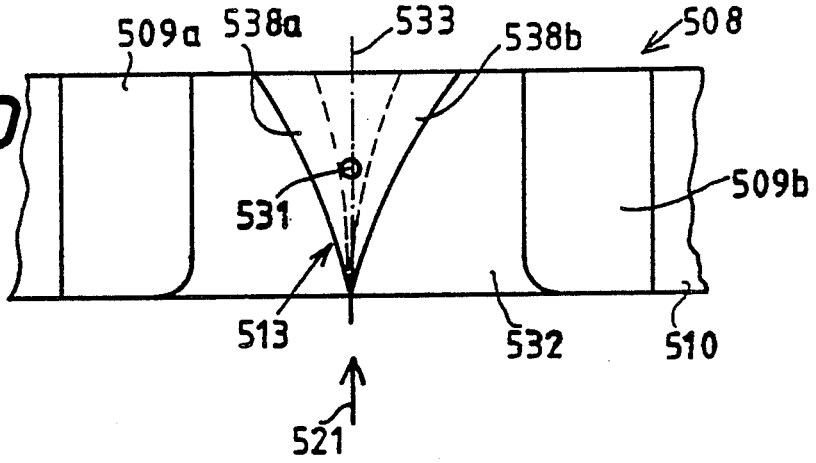
FIG. 5*b* is a top-plan view of the sliver guide of FIG. 5*a;*
Figure 5C:
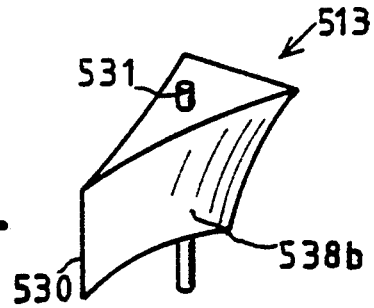
FIG. 5*c* is a perspective view of the sliver divider of FIGS. 5*a* and 5*b;*

A further embodiment of the sliver divider according to the invention is shown in FIGS. 5*a*–5*c*.

The sliver guide 508 illustrated in FIG. 5*a* has a sliver divider 513 located centrally between the two side walls 509*a* and 509*b*, which are mounted on a support 510. The sliver divider 513, as shown in the top-plan view of FIG. 5*b* is rotatable about a pivot shaft 531. The pivot shaft 531 is perpendicular to the travel plane 532 of the sliver which is parallel to the support 510. Accordingly, the pivot shaft 531 is also disposed perpendicularly to the support 510. The sliver divider 513 is again wedge-shaped, with its blade or narrow edge 530 vertical and facing upstream opposite the direction of travel of the sliver 521. The narrow edge 530 and the pivot shaft 531 are both located in a plane 533, as can be seen from FIG. 5*b*. This plane is at right angles to the travel plane 532, or in other words perpendicular to the support 510. In the entry region of the sliver, the side walls 509*a* and 509*b* of the sliver guide are slightly rounded. The side walls of the sliver divider 513, that is, the walls 538*a* on the left and 538*b* on the right, have a plowshare-like curvature.

FIG. 5*b*, in combination with FIG. 5*a*, shows that both side walls 538*a* and 538*b* of the sliver divider 513 are curved three-dimensionally toward the top and back, as viewed in the direction of sliver travel, which is indicated by the arrow 521.

The perspective view of the sliver divider in FIG. 5*c*, illustrates the construction of the side walls, in this case the side wall 538*b*, particularly clearly.

As a result of the concave curvature of the side walls of the sliver divider 513, the sliver is compacted in the narrowing of the sliver canal at the end of the sliver guide between the side walls. With the aid of the plowshare-like side walls of the sliver divider, deflection of the fibers upward, out of the sliver guide, can be prevented.

Regardless of the construction of the side faces of the sliver divider, the side walls of the sliver guide may also be embodied as concave or convex; this construction will depend on certain fiber parameters, which are clearly within the knowledge of the ordinary person skilled in the art.

The fifth embodiment of the sliver divider 613 according to the invention, as illustrated in FIGS. 6*a* to 6*c*, has a sliver guide 608 with adjustable side walls 609*a* and 609*b*. Longitudinal slots 612*a* and 612*b* have been milled into the side walls 609*a* and 609*b*, respectively, at right angles to the direction 621 of sliver travel. Bolts 611*a* and 611*b*, respectively, extend through the slots 612*a* and 612*b* and with them the side walls are firmly screwed to the support 610. Once these screws are loosened, the side walls can be displaced and rotated in the oblong slots. This makes it possible to perform special sliver divisions. The division of the sliver can be performed asymmetrically as well, with a stationary sliver divider 613, in order to divide the sliver into different sliver widths.

In the exemplary embodiment, the sliver divider 613 is disposed symmetrically between the two side walls 609*a* and 609*b*. The sliver divider 613 has a shape that is similar to a bow of an inverted ship, standing on its head. The blade or narrow edge 630 extends in the manner of the keel of a ship's bow. The sliver divider 613 is rotatable about a pivot shaft 631, which is perpendicular to the travel plane 632 of the sliver. Accordingly, it is also perpendicular to the support 610. The side walls 609*a* and 609*b* have a concave curvature, adapted to the bow-like shape of the sliver divider 613.

As can be seen in FIGS. 6*a* and 6*b*, the construction of the sliver divider 613 is symmetric with respect to a plane 633, which passes through the pivot shaft 631 and the narrow edge 630. The bow faces upstream, against the direction 621 of sliver travel. The side walls 609*a* and 609*b* have a funnel-like widening, to enable smooth entry of the sliver into the sliver guide.

As seen in all of the preceding exemplary embodiments, the narrow points in the sliver guide are located downstream of the pivot shaft 631 of the sliver divider 613, as viewed in the direction of sliver transport 621.

The section line C—C in FIG. 6*b* indicates the cross-section of the sliver divider and sliver guide in FIG. 6*c*. There, the bow shape of the sliver divider is particularly clearly visible.

Both the sliver divider and the side walls of the sliver guide should be constructed taking the fiber parameters into account. Short and smooth fibers behave differently during sliver division than long fibers, which have a tendency to kink. The sliver divider should part the sliver as gently as possible, and due to its shape displace the two separate strands laterally, as much as possible without disturbing the course of the fibers. The lateral displacement should be far enough so that separate processing of the strands becomes possible.

As a rule, the sliver divider should be easily movable about its vertical pivot shaft, so that it can rapidly follow fluctuations in the fiber content within the sliver and can bring about a suitable change or adjustment in the distribution ratio. With short, rough fibers, however, this could cause erratic behavior of the sliver divider. Accordingly, a sixth embodiment is therefore shown in FIGS. 7*a* and 7*b* in which a sliver divider can be protected against fluttering in such cases.

The sliver guide of FIGS. 7*a* and 7*b* is similar to the one shown in FIGS. 3 and 4. The sliver guide 708 comprises two guide walls 709*a* and 709*b*, which are disposed parallel and which widen in funnel-like fashion facing upstream toward the direction from which the sliver 721 is delivered. The sliver divider 713 is disposed symmetrically between the two guide walls. It is wedge-shaped and its narrow edge or blade 730 points counter to the direction 721 of sliver travel. Its direction of rotation about the axis 731 is perpendicular to the travel plane 732 of the sliver. The narrow edge 730 and the pivot shaft 731 are both located in a plane 733 that is perpendicular to the travel plane 732 and thus is perpendicular to the support 710 on which the guide walls 709*a* and 709*b* are disposed. A damping device 740, the contours of which are suggested in dashed lines, is disposed underneath the support 710.

The cross-section along the line B—B in FIG. 7*a*, which is illustrated in FIG. 7*b*, shows the damping device 740 in a side view. The action of the damping device 740 is adjustable. In the present exemplary embodiment, the damping device comprises a cylindrical cup 741 mounted underneath the support 710. The shaft 731 of the sliver divider 713 protrudes into this cup and has a vane 742, which completely fills one half of the cup cross section. In the same plane of the vane, directly behind it in the position of repose, the cup is divided in its other half by a fixed partition 743. The cup may be filled with air or with a damping fluid. The cup is divided into two halves by the vane 742 and the partition 743. If the sliver divider 713 is deflected to one side, the fluid or air is forced against the fixed partition 743 by the vane 742. Motion of the vane would be more or less prevented, if the partition 743 did not have an opening 744 through which the medium in the cup could flow into the other half. The size of the opening determines the quantity that can flow to the other half per unit of time and thus the damping action of the damping device 740 as well. For this reason, the opening 744 is closable to a variable extent by a slide 745. The damping action can thus be adjusted in an infinitely graduated manner.

The damping device illustrated in FIG. 7*b* is merely one exemplary embodiment of the damping devices known in the prior art. A person skilled in the art would be able to decide which type of damping device should be used with the invention according to the above specification in order to achieve the desired results.

The foregoing is a description corresponding in substance to German Application P 39 33 218.7, dated Oct. 5, 1989, the International priority of which is being claimed for the instant application under 35 U.S.C 119, and which is hereby made part of this application. Any material discrepancies between the foregoing specification and the aforementioned corresponding German application are to be resolved in favor of the latter.

We claim:

1. A sliver dividing device in a drafting arrangement of a spinning machine, with a sliver travelling through a sliver guide in a given direction and defining a given plane, comprising a sliver divider for dividing the sliver into at least two strands to be delivered to a work station for further processing, said sliver divider being movable in a direction substantially perpendicular to the given direction and substantially parallel to the given plane.

2. A sliver dividing device in a textile machine with workstations for a sliver travelling in a given direction and defining a given plane, comprising a sliver divider for dividing the sliver into at least two strands to be delivered to a work station for further processing, said sliver divider being movable in a direction substantially perpendicular to the given direction and substantially parallel to the given plane.

3. The device according to claim 2, including guide walls for guiding the sliver, said sliver divider being disposed between said guide walls.

4. The device according to claim 3, wherein said sliver divider is disposed symmetrically between said guide walls.

5. The device according to claim 3, wherein said sliver divider is disposed asymmetrically between said guide walls.

6. The device according to claim 3, wherein said guide walls are disposed movably and rotatably.

7. The device according to claim 2 wherein the sliver travels in a given plane, including a pivot shaft having a longitudinal axis disposed substantially perpendicularly to the given plane, said sliver divider being rotatable about said pivot shaft.

8. The device according to claim 7, wherein said sliver divider is in the form of a wedge having a narrow edge, the narrow edge of the wedge facing upstream to the given direction.

9. The device according to claim 7, wherein said sliver divider has side walls, said side walls having the shape of a plow-share.

10. The device according to claim 7, wherein said sliver divider has the form of an inverted ship's bow.

11. The device according to claim 7, wherein said sliver divider is subjected to a given torque from the sliver, including means attached to said pivot shaft for generating a counterforce acting against the given torque.

12. The device according to claim 7, further including slideably disposed guide walls, said sliver divider being disposed between said guide walls.

13. The device according to claim 2, wherein said sliver divider is in the form of a wedge having a narrow edge, the narrow edge of the wedge facing upstream to the given direction.

14. The device according to claim 13, wherein said narrow edge of said sliver divider and said longitudinal axis are located in a common place.

15. The device according to claim 14, wherein said sliver divider is substantially symmetric with respect to the common plane.

16. The device according to claim 2, wherein said sliver divider has side walls, said side walls having the shape of a plow-share.

17. The device according to claim 2, wherein said sliver divider has the form of an inverted ship'bow.

18. The device according to claim 2, further including slideably disposed guide walls, said sliver divider being disposed between said guide walls.

19. The device according to claim 2, further including pivotably disposed guide walls, said sliver divider being disposed between said guide walls.

20. The device according to claim 2, further including pivotably and slideably disposed guide walls, said sliver divider being disposed between said guide walls.

* * * * *